United States Patent [19]

Quong

[11] Patent Number: 4,618,069

[45] Date of Patent: Oct. 21, 1986

[54] SHIPPING-AND-STORAGE CONTAINER

[76] Inventor: Paul Quong, 1914 Orangewood Ave., No. 102, Orange, Calif. 92668

[21] Appl. No.: 650,272

[22] Filed: Sep. 14, 1984

Related U.S. Application Data

[63] Continuation-in-part of Ser. No. 591,854, Mar. 21, 1984, abandoned.

[51] Int. Cl.[4] ..... B65D 21/02; B65D 1/36; B65D 69/00; B65D 25/04

[52] U.S. Cl. ..... 220/23.4; 206/509; 206/512; 220/21; 220/23.6; 220/23.8; 229/915

[58] Field of Search ..... 220/21, 22, 23.4, 23.6, 220/23.8; 206/509, 512; 229/DIG. 11

[56] References Cited

U.S. PATENT DOCUMENTS

| | | | |
|---|---|---|---|
| 3,106,308 | 10/1963 | Kazimier | 220/21 |
| 3,167,458 | 1/1965 | Brazell | 220/23.4 |
| 3,203,573 | 8/1965 | Rowe | 220/23.6 |
| 3,266,704 | 8/1966 | Deeren | 220/21 |
| 3,272,378 | 9/1966 | Weber | 220/21 |
| 3,341,053 | 9/1967 | Keene | 220/23.4 |
| 3,448,914 | 6/1969 | Scholz | 206/512 |
| 3,463,378 | 8/1969 | Van Daalen | 206/512 |
| 3,501,044 | 2/1970 | Stone | 220/23.4 |
| 3,502,241 | 3/1970 | Smith | 220/23.8 |
| 3,539,071 | 11/1970 | Ludder | 220/23.4 |
| 3,651,976 | 3/1972 | Chadbourne | 220/23.4 |
| 3,660,934 | 5/1972 | Pollack | 220/23.4 |
| 3,667,647 | 6/1972 | Van Daalen | 206/509 |
| 3,884,381 | 5/1975 | Kaupert | 220/23.6 |
| 3,982,655 | 9/1976 | Kaupert | 220/23.6 |
| 4,242,834 | 1/1981 | Olsen | 47/78 |
| 4,432,456 | 2/1984 | Ovadia | 206/509 |

FOREIGN PATENT DOCUMENTS

| | | | |
|---|---|---|---|
| 836645 | 1/1939 | France | 229/DIG. 11 |
| 851371 | 1/1940 | France | 229/DIG. 11 |
| 2292631 | 6/1976 | France | 229/DIG. 11 |
| 1146029 | 3/1969 | United Kingdom | 206/509 |

*Primary Examiner*—George E. Lowrance
*Attorney, Agent, or Firm*—Francis X. LoJacono

[57] ABSTRACT

This invention defines an improved shipping-and-storage container unit for produce, more particularly the berry-type fruit such as strawberries. The container unit is formed having a basket-support tray in which a plurality of receptacles are formed to receive baskets therein. The container includes a peripheral frame member which provides an interlocking arrangement between containers when placed in a stacked mode, one above the other. The interlocking arrangement further includes a basket-securing means, whereby the baskets are secured as long as the peripheral frame member is mounted about the basket-support tray.

42 Claims, 13 Drawing Figures

SHIPPING-AND-STORAGE CONTAINER

CROSS-REFERENCE TO RELATED APPLICATION

This application is a continuation-in-part of application Ser. No. 06/591,854 filed Mar. 21, 1984, now abandoned, by the same inventor as in the present application and having the same title.

BACKGROUND OF THE INVENTION

1. Field of the Invention

This invention relates generally to shipping and storage containers, more particularly for use with fruit and vegetable produce, especially strawberries.

2. Description of the Prior Art

There are various problems and difficulties being encountered in providing suitable means for shipping and storing berry produce.

Currently, the strawberry industry employs a corrugated paper, box-like tray that is so constructed as to include two compartments defined by a central partition. Each compartment is formed to receive a group of six baskets, for a total of twelve baskets. Such trays are used in large quantities and are thus generally supplied to the growers in collapsed form, so that an assembly machine must be employed to erect each tray in order to receive twelve plastic, web-like baskets, which are well known in the art. In fact, at the present time the above-described shipping-and-storage trays and plastic baskets are the only ones being employed in the strawberry industry.

When loaded with berry baskets, the known trays must be stacked on pallets which normally provide for sixteen layers of trays, arranged six to each layer, for a total of ninety-six per pallet. However, in order to stack the layers in such an arrangement, a pair of stacking wires must be inserted into each tray, one wire in each end wall, so as to link the tray with the superposed tray. This stacking arrangement has not been found to be completely satisfactory for long periods of time during hauling. The stacked load must also be carefully handled so as to prevent tipping, which often occurs.

Due to the paper-type construction of these trays, they can not be exposed to a wet environment because their individual compressive strength will change, allowing the well structures of the trays to collapse and thereby crushing the berries stored therein.

Further, the arrangement of the trays and their baskets results in unsatisfactory grower yield per acre, since more berries are picked and stored in each tray of baskets than are needed. This situation causes additional handling at store level because each individual basket must be removed from its tray and repackaged to provide for the excess berries. Even though the store can fill two or three additional baskets, it is costly—since it is time-consuming and expensive to have high-salaried store clerks handle the unpacking and repacking of the berries.

As other examples of the various storage containers and systems for packaging, one may refer to the following U.S. patents.

U.S. Pat. No. 3,539,071 to R. E. Ludder discloses a packaging structure that includes a plurality of nestable container such that individual containers are positioned and retained in a carrier tray. The actual carrier-container assemblies are placed in cartons and shipped to the respective dairies, etc., which fill the individual containers while they remain in the carrier trays; and the carrier trays are then repackaged in cartons or the like for shipment to the end user.

U.S. Pat. No. 3,651,976 to G. R. Chadbourne discloses a molded packaging tray comprising a plurality of interconnected elongated container sections. The trays are formed for stacking, one above the other, with alternate trays being oriented differently from adjacent ones.

U.S. Pat. No. 3,884,381 to G. Kaupert discloses a nestable compartmentalized tray made of thin sheet material and having a plurality of downwardly marrowing cup-shaped depressions. Trays of this structure may be nested in one another to form a tray stack.

Another nestable and stackable support tray is disclosed in U.S. Pat. No. 4,242,834 to R. C. Olsen. This tray is particularly designed as a planting system that includes a support tray, a plurality of interconnected sleeves, and a plurality of transplant frames adapted for insertion within each sleeve.

SUMMARY OF THE INVENTION

The present invention has for an important object a provision wherein various types of produce can be readily stored and transported in a container unit over long distances without damage to the produce, the container unit including a lightweight frame structure defining a tray having a plurality of contiguously formed receptacles adapted to receive a plurality of lightweight baskets. Mounted about the tray structure in a corrugated peripheral frame member which defines a means for securing the baskets within the tray, and further provides a means for stackably interlocking superposed container units.

Another object of the present invention is to provide a shipping-and-storage container unit for fresh produce wherein a plurality of containers can be stacked in an interlocking arrangement to allow safe shipping or transporting by pallets, without the need for wires or tie sheets as are now required.

Still another object of the present invention is to provide a lightweight, durable, shipping-and-storage container for produce that can also be used as a retail-packaging unit so as to further establish, at store level, a unit of this type that can be quickly and easily prepared for display without the need for sorting and repacking, since the supporting frame structure of the tray may be cut away to provide for a three-pack display without the need for additional chipboard boxes, as would be currently required.

A further object of the invention is to provide a shipping-and-storage container of this character that allows additional units to be loaded on trucks for long-range transportation due to the unique high-compressive and flexual strength level of each loaded container unit, the compressive-strength performance being unchanged regardless of ambient temperatures and/or moisture exposure. Strength levels achieved in the present device are not dependent upon quality of glue joints as in existing containers used in the strawberry industry.

A still further object of the present invention is to provide a device of this character wherein the tray is formed having four separate sections arranged to be coupled to each other when bound by the peripheral frame member. Each tray section can be individually used as a three-pack-display support tray.

Still a further object of the present invention is to provide a container of this character that allows a predictable quantity of fruit to be packed in each basket, which then allows an increased per-acre yield for the grower.

Still another object of the invention is to provide a device of this character that is relatively inexpensive to manufacture, and that is simple yet rugged in construction.

The characteristics and advantages of the invention are further sufficiently referred to in connectuon with the accompanying drawings, which represents three embodiments. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
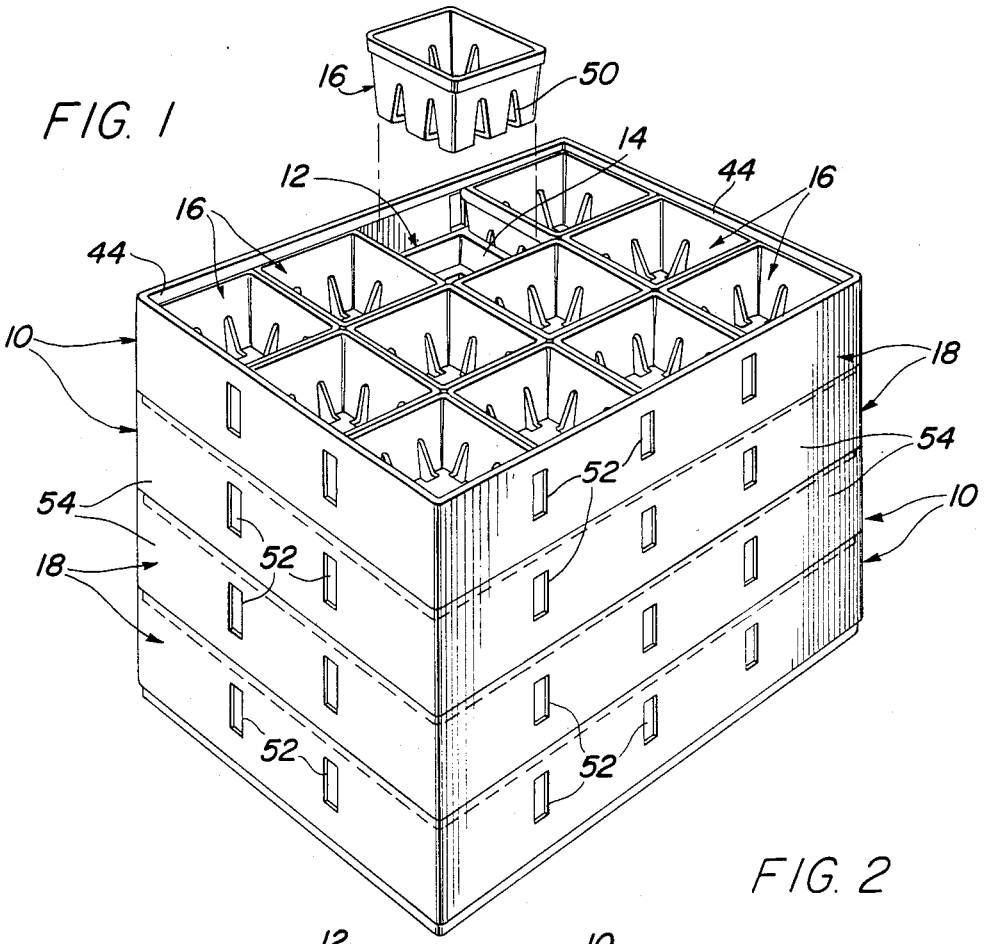
FIG. 1 is a perspective view of a plurality of stacked shipping-and-storage-container units, one of the inserted baskets being separated in an exploded position so as to illustrate one of the receptacles formed in the tray structure.
Figure 2:
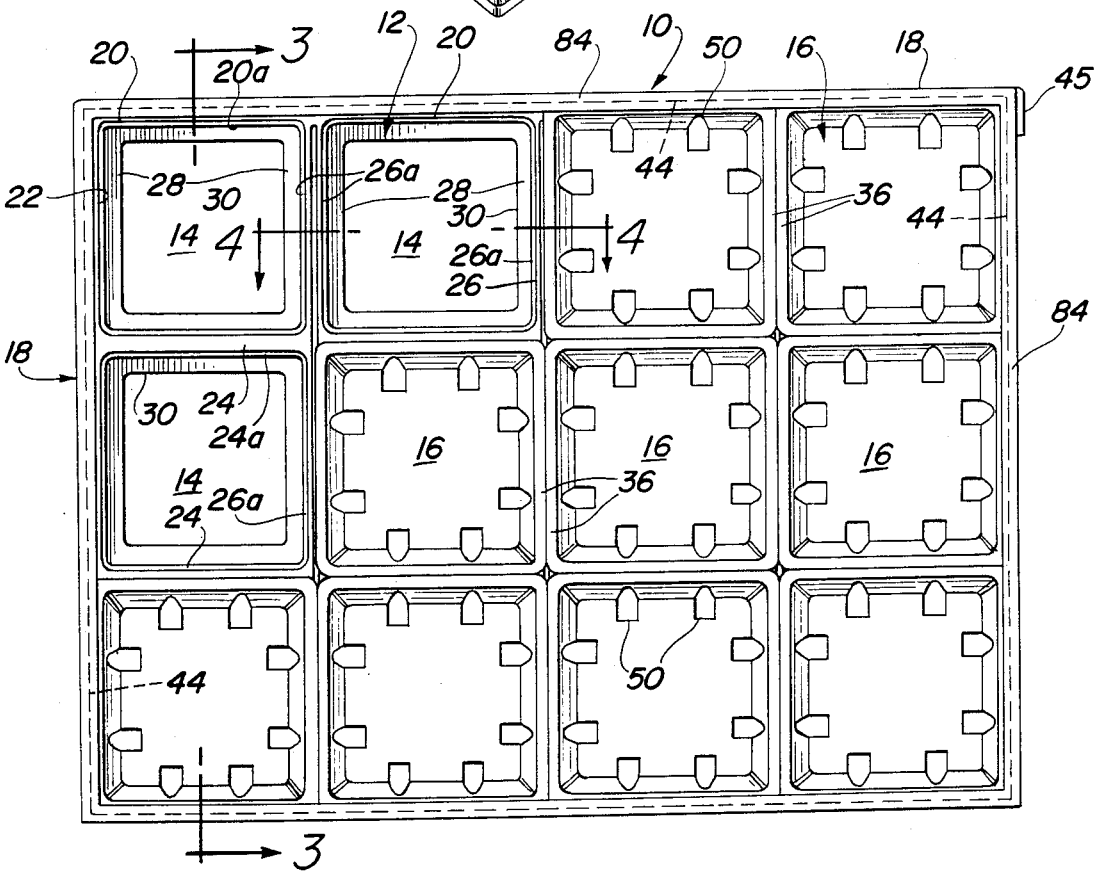
FIG. 2 is a top-plan view of the present invention showing some of the baskets removed from the receptacles.

Referring first to the embodiment illustrated in FIGS. 1 through 4, and more particularly FIG. 1, there is shown a plurality of stacked shipping-and-storage container units, generally indicated at 10. When the container units are stacked as shown, the exterior side walls of each container form a contiguous and unobtrusive exterior which allows for easy stacking on pallets in a more secure interlocking manner than has been possible heretofore.

Accordingly, the present invention defines a produce shipping-and-storage container 10 which will hereinafter be referred to as a "container unit", the invention being particularly adapted to store and ship berries, especially strawberries. Each container unit comprises a basket-support tray, generally designated at 12, having a plurality of receptacles 14 which are formed in a contiguous manner to receive and support individual baskets 16 therein in a releasably secure mode by means of a peripheral frame member 18.

The basic structure of the present invention comprises a basket-support tray 12 formed from expandable polystyrene material and having a substantially rectangular configuration defined by peripheral side walls 20 and 22, the side walls 20 being the longitudinal members and the side walls 22 being the transverse members. In order to establish the plurality of receptacles 14, the longitudinal inner wall members 24 and 26 are integrally formed between side walls 20 and 22. Preferably, support tray 12 includes a pair of longitudinal inner wall members 24 together with three transverse inner wall members 26. Hence, there is formed a plurality of contiguous square-shaped openings that define receptacles to receive and support baskets 16. Each receptacle is further formed having an inner shoulder member 28 which establishes an inner peripheral rib member 30. In order to provide a secure fit between baskets 16 and their tray 12, the upper portions **20*a*, 22*a*, 24*a* and 26*a* of the tray wall sections 20, 22, 24 and 26 are formed with inner tapered surfaces, such as shown at 31 in FIGS. 3 and 4. Accordingly, baskets 16 are also provided with tapered or inclined walls 32 to match the inner tapered surfaces 31** of the tray.

Figure 3:
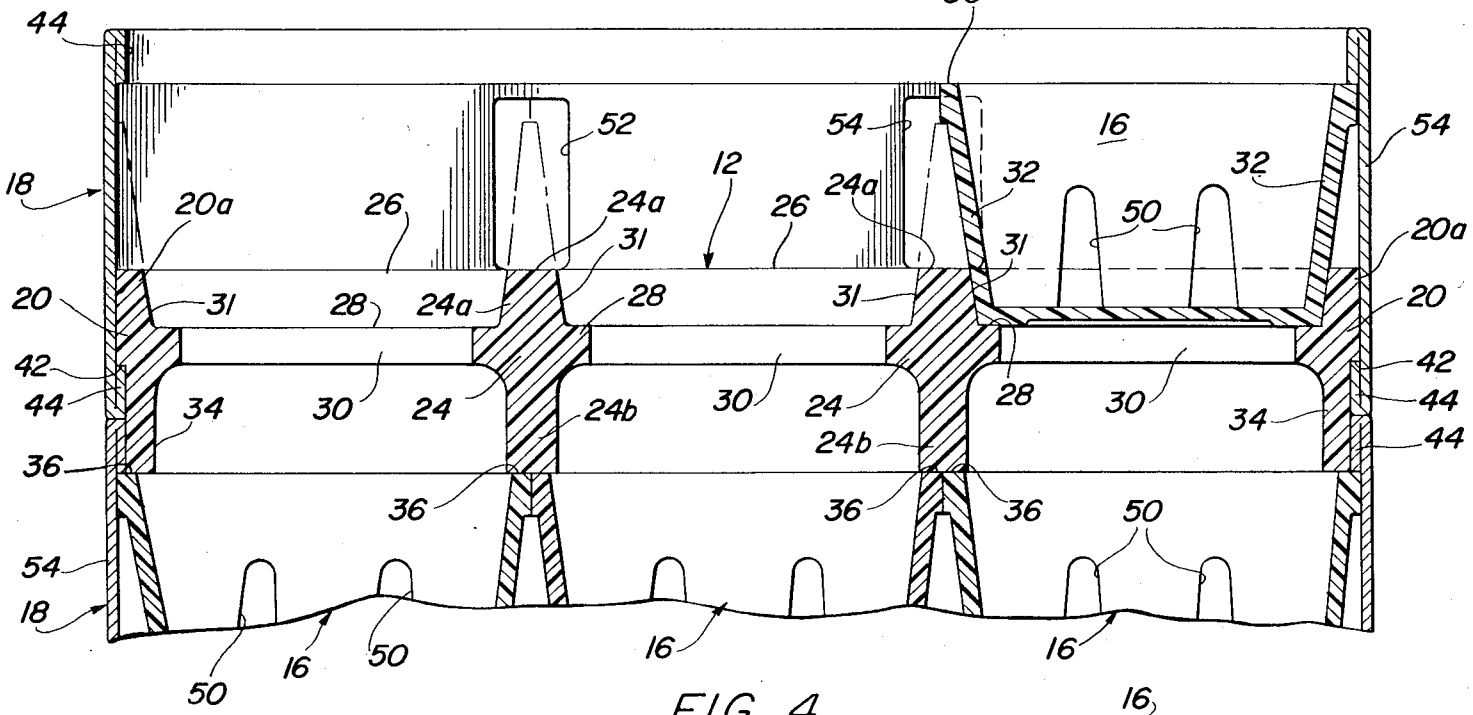
FIG. 3 is an enlarged cross-sectional view taken along line 3—3 of FIG. 2.

The lower portions of the outer peripheral walls 20 and 22 form depending members 34, the inner walls 24 and 26 having lower depending walls **24*b* and 26*b*, respectively. Depending wall portions 34, 24*b* and 26*b* extend downwardly so as to rest upon the upper peripheral edges 36 of baskets 16 when in a stacked mode, as shown in FIGS. 1 and 3. Thus, as the container units 10 are stacked when loaded with berries (not shown), weight is evenly distributed over the entire structure of each unit 10**. Therefore, because of the structure of the trays and the baskets, suitable compressive strength is established between the stacked units, allowing greater weight-support ratio than heretofore found in the present devices. The baskets are also preferably formed from expandable polystyrene material which provides for close-fitting tolerances between the polystyrene baskets and their polystyrene tray.

In order to provide an even more secure container unit, the peripheral frame member 18 is formed to define a basket-securing means by which the baskets are securely held in the tray receptacle during storage and particularly when the container units are being transported. Peripheral frame member 18 defines a second means that allows each unit to be stacked in a stable interlocking arrangement. Thus, several layers of container units 10 can be readily stacked, one on top of the other, without the chance of being accidentally separated. This is accomplished by forming the outer surface of walls 20 and 22 with a ridge 42 which is engaged by an inner flange or lip member 44 of frame member 18. That is, the frame member is preferably formed from an elongated narrow sheet of corrugated board or similar material which includes a pair of oppositely disposed ribs or flanges 44 formed along the edges thereof. The oppositely disposed flanges are arranged to permit the lower flange to engage ridge 42, and the opposite upper flange to engage the contiguously positioned baskets along their peripheral edges, as seen in FIG. 3. After the baskets are positioned in the receptacles 14, frame member 18 is wrapped about the tray structure 12 and the free ends are secured in a suitable manner, such as by gluing tab 45 to the connecting free ends. To remove the baskets, the framework member 18 is simply removed by any suitable means, such as cutting the corrugated board with a razor blade. The removal of the peripheral securing member 18 allows the baskets to be freely supported by the tray structure 12. Thus, the produce stored therein is readily displayed for sale at the retail level, each basket of fruit being available for removal from the tray.

Figure 4:
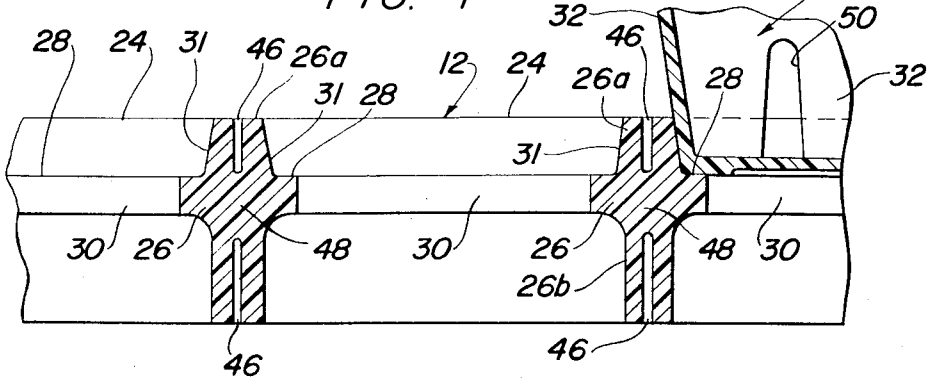
FIG. 4 is an enlarged cross-sectional view taken along line 4—4 of FIG. 2.

However, produce such as strawberries is often sold in groups of three baskets. Therefore, the inner transverse wall members 26 are formed to include separating means to allow the support tray 12 to be divided into a plurality of sectional groups. The separating means is defined by a pair of slots 46 disposed longitudinally along the upper and lower portions of the transverse walls. FIG. 4 shows how a connecting intermediate web 48 is formed between the oppositely disposed slots 46. In order to separate the tray into four individual sets of three receptacles, one can use any suitable cutting instrument. However, a hot-wire cutting device is the most preferred cutting tool for expandable polystyrene material.

As mentioned above, the baskets 16 employed with the basket-support tray 60 are also preferably formed from the same expandable polystyrene material as the tray, the walls and base member of each basket including at least one vent aperture 50 to allow air to circulate between the stored berries. In order to aid in air circulation within the units, particularly when they are stacked as in FIG. 1, air vents 52 are also provided about the peripheral walls 54 of the securing frame 18.

Alternative Embodiments

Figure 5:
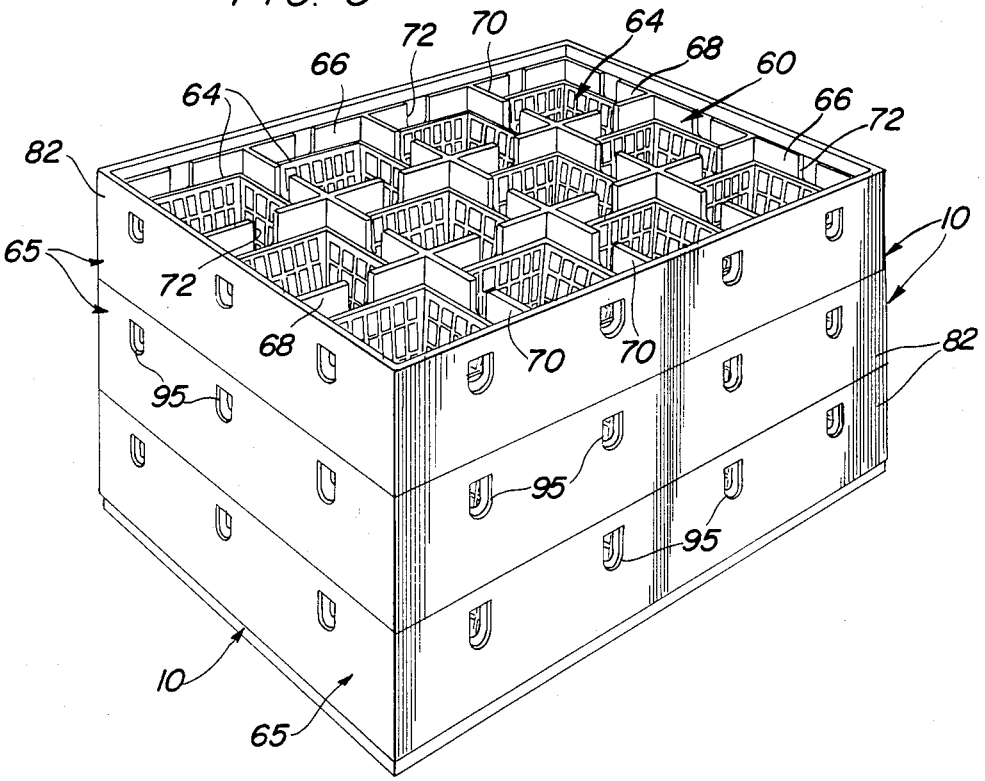
FIG. 5 is a perspective view showing a second embodiment of the present invention, that is in a stacked form.
Figure 6:
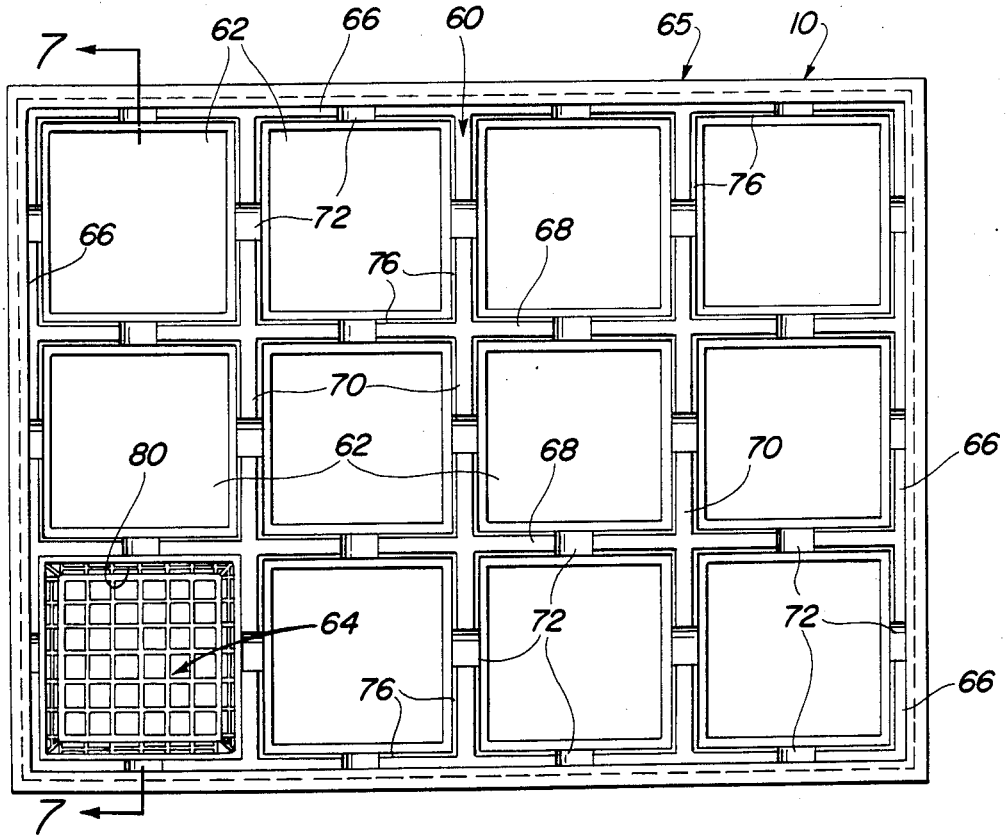
FIG. 6 is a top-plan view thereof.
Figure 7:
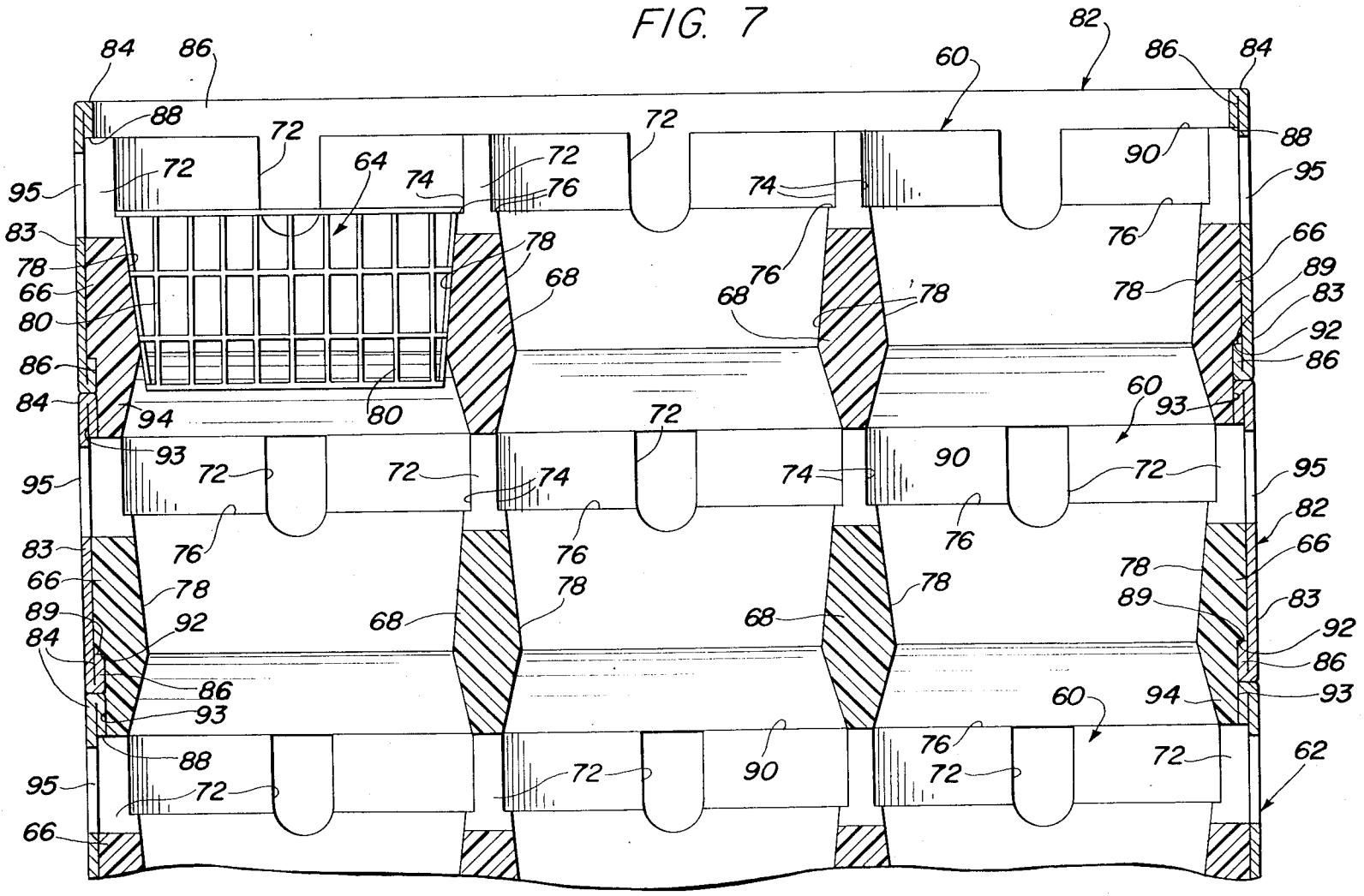
FIG. 7 is an enlarged cross-sectional view taken substantially along line 7—7 of FIG. 6.

Referring now to FIGS. 5 through 7, there is illustrated a second embodiment of the present invention which also comprises the three basic elements of the invention in the first embodiment, these being a basket-support tray 60 having a plurality of receptacles 62, baskets 64 adapted to be supported in the receptacle 62, and a basket-securing means defined by peripheral frame member 65.

Basket-support tray 60 is formed preferably from expandable polystyrene material which is well known in the art. This material is lightweight but can support loads many times its own weight in compression. Thus, it allows for safe stacking of large numbers of completely loaded container units 10. In this embodiment, the tray has a frame structure that includes outer peripheral walls 66 which define a substantially rectangular configuration and has integrally formed inner walls 68 and 70, as seen in FIG. 6. Walls 68 are formed as a pair of longitudinally disposed partitions, while walls 70 are disposed transversely thereto so as to define twelve receptacles, indicated at 62. In each wall of each receptacle 62, there is formed at least one enlarged notch or aperture 72 which establishes an air-flow means to allow air to flow through each contiguous receptacle 62. The upper portion of each wall defining each receptacle is formed having an enlarged recess 74.

The bottom of each recess forms a support lip or shoulder 76 which allows baskets 64 to be supported in the respective receptacles. To assist in supporting the baskets, particularly when fully loaded with produce, the inside surfaces 78 of the tray are inclined downwardly and inwardly to correspond to the inclined or tapered walls 80 of the baskets. The baskets, illustrated in FIGS. 5 through 7, are the common berry baskets presently in use. These baskets are made of web-like plastic and are very suitable and compatible with tray 60. Thus, the midsection of each receptacle is formed to readily accept both the basket 64 as well as the basket 16 in the first embodiment.

In order to establish a strong structure for shipping, there is also provoded a locking means 82 which comprises a continuous, outer, peripheral wall frame 83 that covers the four outer walls 66 of tray 60. Wall frame 83 also is preferably formed from an elongaged narrow sheet of corrugated board or similar material. The longitudinal edges 84 are made thicker, such as by doubling them over to form an inner flange member 86. When the outer wall frame 83 is positioned about tray 60, the free edge or shoulder 83 engages the upper free edges 90 of the peripheral walls 66 of the tray. The oppositely disposed free edge of shoulder 89 of frame 83 is placed to engage the peripheral lip or shoulder 92 formed in the lower outer surface of walls 66, clearly seen in FIG. 7. The lip or shoulder is defined by a contiguously formed lower recess 93 disposed in the extended lower portion 94 of outer walls 66. Accordingly, the extended portion 94 of each tray together with the oppositely disposed flanges 86 of outer frame member 60 combine to form a locking means between the stackable units 10. That is, recess 93 is adapted to receive both the upper and lower flange members 86, thus securing each superposed shipping-and-storage container in place, as shown in FIGS. 5 and 7. Hence, the lower or bottom free edges of each wall member 66, 68 and 70 will rest and be supported in a substantially fixed arrangement with the wall members of the adjacent stacked container 10.

It should be noted that the walls of the outer frame structure also include openings or apertures 95 which align with adjacent apertures 73 in tray 60.

However, in this embodiment baskets 64 can be inserted or readily removed from the tray without the need for removing the peripheral frame 65.

Figure 8:
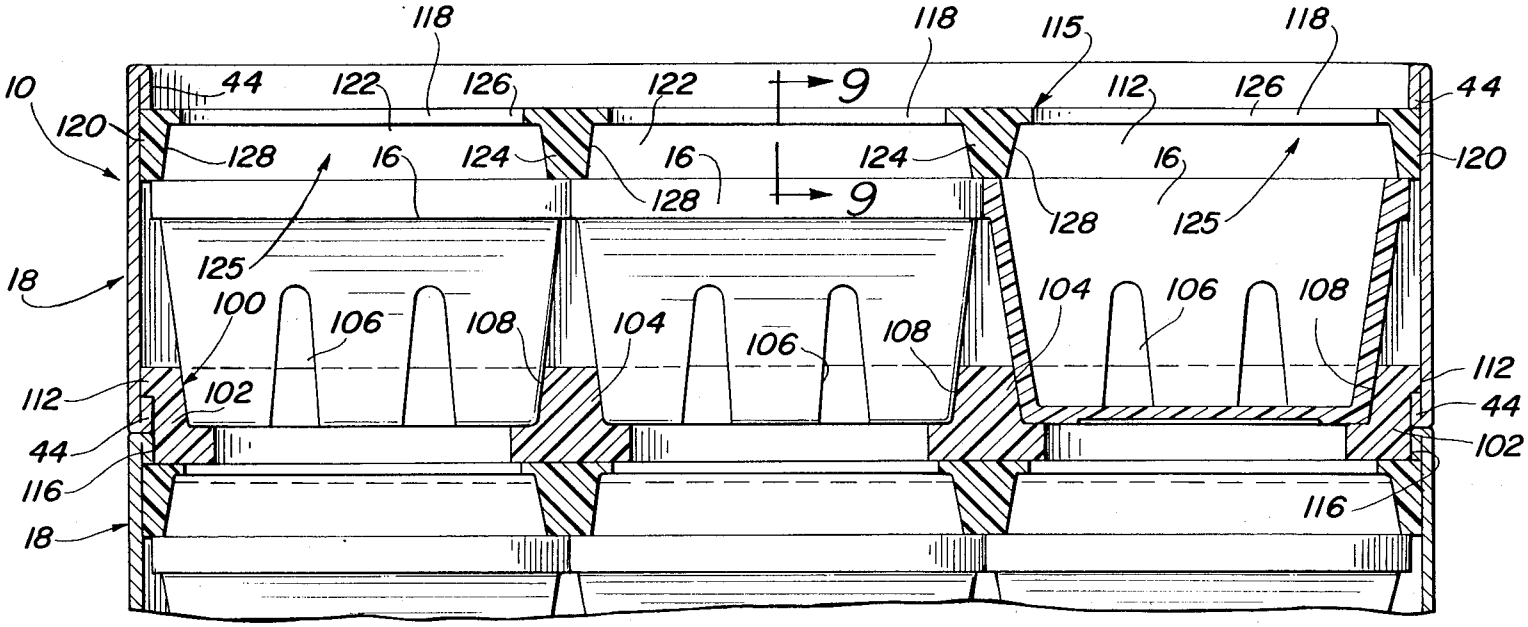
FIG. 8 is a transverse cross-sectional view similar to FIG. 3, illustrating a third embodiment of the invention wherein this embodiment includes a secondary frame structure.
Figure 9:
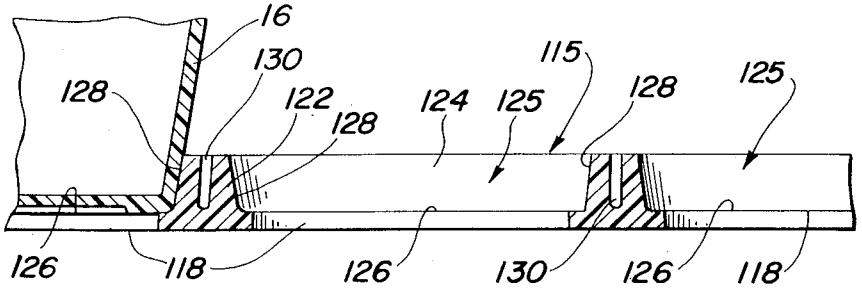
FIG. 9 is a cross-sectional view of the secondary frame structure shown being used as a secondary tray.
Figure 13:
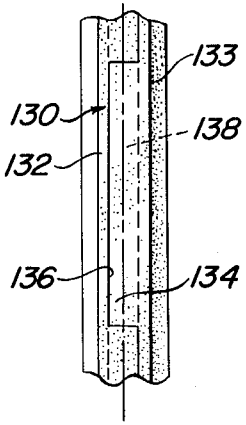
FIG. 13 is an enlarged top-plan view of a portion of the coupling means, as shown in FIG. 11.

Referring now to the third embodiment of the present invention, illustrated in FIGS. 8 and 9, there is shown a basket-support tray 100 formed somewhat like the basket-support tray 12 in FIG. 3, but without the lower extended portion defined by wall portions 34, **24*b* and 26*b*. That is, basket-support tray 100 comprises a substantially rectangular, flat, frame structure defined by peripheral walls 102**.

Integrally formed with the peripheral walls 102 are longitudinal inner walls or partitions 104 and transverse inner walls or partitions 106 which define contiguous receptacles 108. Each receptacle is formed having an inner, peripheral, shoulder member 110 whereby baskets 16 are individually supported therein. The upper outer edge of peripheral wall 102 is also provided with a shoulder or ridge 112 which allows flange 44 of peripheral frame member 18 to engage under ridge 112 and extend upwardly to lockingly engage a secondary frame structure, generally indicated at 115, by means of the oppositely disposed flange 44. Thus, for handling, shipping and storage, container 10 is assembled as shown, all of the baskets 16 being interposed between the first frame structure 100 and the secondary frame structure 115. The secondary frame structure is designed to provide additional functions not established in the previous embodiments.

Accordingly, the locking means of peripheral frame member 18, as illustrated in FIG. 8 of the third embodiment, defines a secondary locking means. That is, each stacked container or unit 10 is interlocked to the lower container, as described with respect to the first embodiment. Thus, the upper extended flange or lip 44 of peripheral frame 18 is received in recess 116, thereby locking tray 100 to the unit below. At the same time, upper flange 44 secures the secondary frame structure 115 against the top portion of each basket 16. Prior to filling, the twelve baskets are secured in each container 10, and then the berries are loaded through openings 118. The openings are defined by the frame structure which comprises a peripheral wall 120, transverse inner walls 122, and longitudinal inner walls 124, which further define contiguous receptacles 125. These walls are integrally formed perferably also from an expandable polystyrene material; and they comprise an inner peripheral flange or lip 126 and inclined inner wall surfaces 128. Lip 126 and inclined inner wall surfaces 128 are designed to receive baskets 16, as illustrated in FIG. 9. Hence, when the outer frame 18 is removed, the secondary frame structure 115 may also be removed and used as a tray similar to tray 100, as illustrated in FIG. 9.

FIG. 9 further illustrates a longitudinal cross section of the secondary structure wherein the transverse walls 122 are formed having separating means which comprises an elongated slot 130 formed within the central portion of each transverse wall 122. Each slot permits a set of three contiguous receptacles 125 to be separated along the respective slots, whereby three baskets are supported in their own smaller tray section, since berries are very often sold at the retain level in groups of three baskets.

FIGS. 10 through 13 illustrate an alternative arrangement of basket-support tray 100. In this arrangement, indicated at 101, the basket-support tray comprises a plurality of individual support-tray sections that are held together by means of an outer frame member 18 and by coupling means, generally indicated at 130, the coupling means being interposed between contiguous, transverse side walls of the separate tray sections. There are two pairs of tray sections—a pair of outer tray sections indicated generally at 103, and a pair of intermediate tray sections indicated at 105. Each tray section is formed with three contiguous receptacles 14, as previously described herein.

The outer tray sections comprise peripheral walls **102*a* having extended shoulders or ridges 112*a* adapted to engage frame member 114 and the inner flange 44, as hereinbefore described with respect to tray 100 in FIG. 8. However, the inner transverse wall or partition 132 is formed having coupling means 130 disposed therein, the three contiguous receptacles 14 being defined by longitudinal walls 104*a*. Each intermediate tray section comprises three contiguous receptacles 14 (seen in FIG. 12) which are defined by transverse walls or partitions 133, and oppositely disposed end walls 102*b* and inner longitudinal walls or partitions 104*a*. When all of the sections are connected together, peripheral walls 102*a* and 102*b* form a complete, continuous, outer peripheral wall similar to peripheral wall 102 of tray 100. Both peripheral walls 102*a* and 102*b* include the extended flange 112*a***.

Accordingly, wall 132 of sections 103 and walls 133 of intermediate tray sections 105 are all provided with matching coupling means 130. The positioning of the coupling means permits the four tray sections to be removably interlocked together to provide a single support tray that carries twelve baskets 16, or four individually separated tray sections supporting three baskets each.

Figure 11:
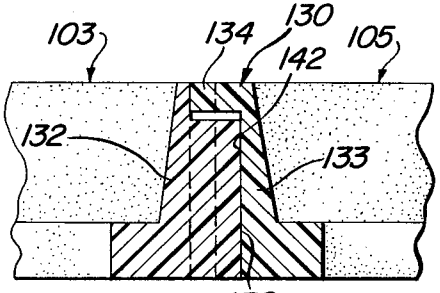
FIG. 11 is an enlarged cross-sectional view taken along line 11—11 of FIG. 10, showing the coupling connection between the sectional tray members.
Figure 12:
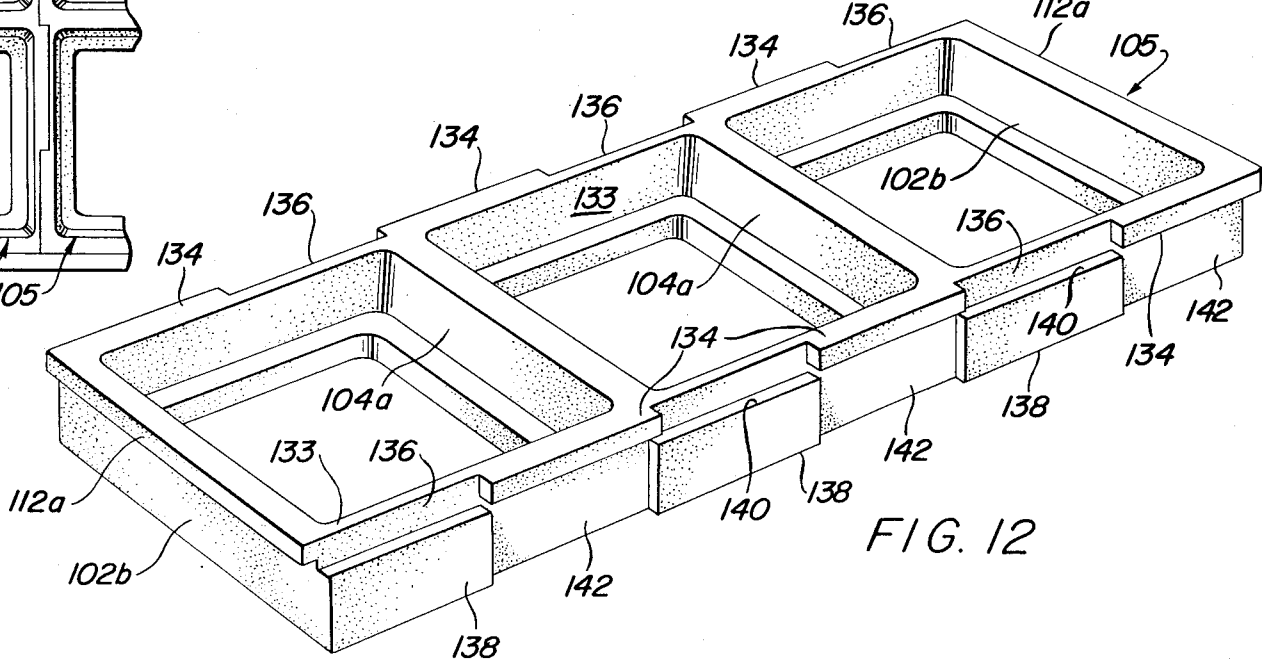
FIG. 12 is a perspective view of one of the sectional trays having the coupling members formed on each longitudinal side thereof.
Figure 10:
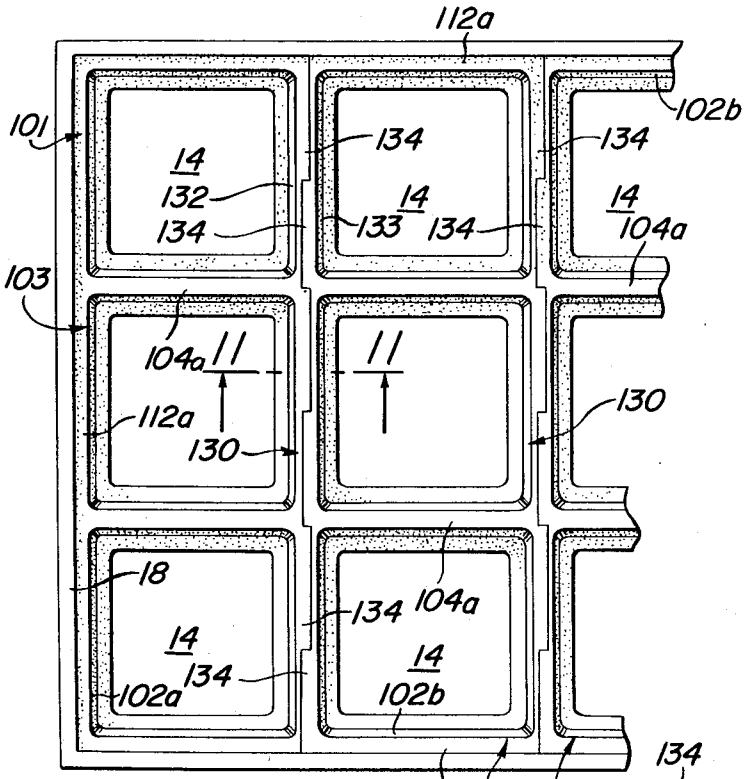
FIG. 10 is a top-plan view of a portion of an alternative arrangement of a support tray having coupled support-tray sections.

Coupling means 130 comprises a plurality of extended tongue members 134, including tongue-receiving recesses 136 interposed therebetween, as illustrated in FIG. 12. Below each recess 136 there is formed a support rib 138 which is provided with a shoulder 140. Since each rib is formed under each recess 136, a rib-receiving recess 142 is formed between or adjacent each rib member. In order to establish a positive coupling between each tray section, the opposing set of coupling elements, tongues 134, tongue recesses 136, ribs 138 and rib recesses 142 are positioned in an offset relationship to the coupling elements of the matching adjacent wall. Thus, the tongue of an adjacent tray section matches the tongue recess of the oppositely positioned tray section, as noted in the drawings. FIG. 11 shows tongue 134 mounted in recess 136, while rib 138 is coupled into rib recess 142.

As long as the four sections are surrounded by outer frame structure 18, each tray section will remain in an intercoupled relationship to the others, thus defining a single, large support tray.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific forms shown or uses mentioned, except as defined in the accompanying claims.

I claim:

1. A container in combination with removable baskets for shipping and storing fresh produce, wherein said combination comprises:

a basket-support tray having a substantially rectangular configuration;

a plurality of baskets adapted to receive said produce for shipping, storage, and display therein, and to be carried by said basket-support tray;

a plurality of open-ended receptacles having upper and lower open ends formed in said basket-support tray, said baskets being removably mounted in said open-ended receptacles;

a peripheral frame member mounted about the outer surface of said basket-support tray; and means formed between said peripheral frame member and said basket-support tray for interlocking a multiplicity of containers in a stacked arrangement to prevent separation thereof during shipping and storage;

wherein said basket-support tray comprises:

an outer peripheral wall structure defined by four side wall members;

a plurality of integrally formed, longitudinally and transversely disposed, inner wall members;

all of said wall members defining said open-ended receptacles to receive and support said baskets therein, whereby the structural load of each superposed container is transferred through each of said wall members when said containers are stacked for shipping or storage.

2. The combination as recited in claim 1, wherein said walls of said receptacles include means for removably supporting said baskets therein.

3. The combination as recited in claim 2, wherein said interlocking means comprises:

a pair of oppositely disposed, longitudinal flanges formed along the upper and lower edges of said peripheral frame member;

a peripheral lip formed in said outer, peripheral, wall structure and adapted to engage said lower flange along said lower edge of said peripheral frame member;

said outer wall structure extending downwardly below said lower edge of said peripheral frame member, and adapted to be received within said upper edge of said peripheral frame member of a container positioned below in an interlocking arrangement.

4. The combination as recited in claim 3, wherein said upper flange of said peripheral frame member engages said baskets when said baskets are supported within said open-ended receptacles.

5. The combination as recited in claim 3, wherein said basket-support means comprises an inner peripheral shoulder formed in the wall surfaces of said open-ended receptacles adjacent said lower opening thereof.

6. The combination as recited in claim 5, wherein the upper portions of said wall surfaces of said open-ended receptacles are formed having inclined planes to provide supporting engagement with the walls of said baskets.

7. The combination as recited in claim 1, wherein said longitudinal walls and said transverse walls are formed having lower extended portions to engage the upper portions of the superposed, adjacent, longitudinal and transverse walls when said containers are stacked for shipping and/or storage.

8. The combination as recited in claim 4, wherein said longitudinal walls and said transverse walls are formed having lower extended portions arranged to engage the upper edges of said baskets disposed in said superposed containers, when said containers are stacked for shipping and/or storage.

9. The combination as recited in claim 8, wherein said peripheral frame member and said baskets include a plurality of apertures formed therein, whereby air is allowed to flow therethrough and therebetween, and through said upper and lower open ends.

10. The combination as recited in claim 7, wherein said peripheral frame member and said support tray include a plurality of apertures formed therein, whereby air is allowed to flow therethrough.

11. The combination as recited in claim 10, wherein said tray and said baskets are formed from an expandable polystyrene material, and said peripheral frame member is formed from a corrugated material.

12. The combination as recited in claim 2, wherein said interlocking means includes means for securing said baskets in said basket-support tray.

13. The combination as recited in claim 2, wherein said shipping and storage container includes a secondary frame structure adapted to be securely positioned over and in engagement with said baskets, so as to retain said baskets in said open-ended receptacles and against said basket-support tray.

14. The combination as recited in claim 13, wherein said secondary frame structure further defines a secondary basket-support tray.

15. The combination as recited in claim 14, wherein said secondary frame structure is formed having a plurality of contiguous open ended receptacles adapted to support said baskets therein.

16. The combination as recited in claim 15, wherein said open-ended receptacles in said secondary frame structure are defined by an outer peripheral wall, a plurality of transverse inner wall members, and a plurality of longitudinal inner wall members, wherein said wall members define upper and lower open ends to receive and support said baskets therein.

17. The combination as recited in claim 15, wherein said transverse inner wall members include separating means, whereby said secondary frame structure is dividable into a plurality of sectional frame members.

18. The combination as recited in claim 13, wherein said interlocking means includes means for securing said baskets in said basket-support tray.

19. The combination as recited in claim 18, wherein said interlocking means and said basket-securing means comprise:

a first longitudinal flange member formed along the upper edge of said peripheral frame member, and positioned to engage said secondary frame structure;

a second longitudinal flange member formed along the opposite lower edge of said peripheral frame member; and a peripheral shoulder formed in said outer wall of said basket-support tray, and positioned to engage said second longitudinal flange member, whereby said baskets are secured between said basket-support tray and said secondary frame structure.

20. The combination as recited in claim 2, wherein said basket-support tray comprises a plurality of tray sections removably coupled together when enclosed in said peripheral frame member.

21. The combination as recited in claim 20, wherein said basket-support tray includes means interposed between adjacent individual tray sections for removably coupling said tray sections together to define said basket-support individual tray.

22. The combination as recited in claim 21, wherein said coupling means comprises:

a plurality of extended tongue members formed along the upper edge of said transversely disposed, inner wall members of each tray section;

a plurality of tongue recesses positioned adjacent and between said tongue members;

a plurality of rib members positioned below said tongue recesses; and a plurality of rib recesses positioned adjacent and between said plurality of rib members, whereby said tongues and rib members of one tray section couple with said tongue recesses and said rib recesses of an adjacent tray section.

23. The combination as recited in claim 13, wherein said basket-support tray comprises:

a plurality of tray sections removably coupled together by said peripheral frame member; and coupling means interposed between adjacent tray sections.

24. The combination as recited in claim 23, wherein said coupling means comprises:

a plurality of extended tongue members formed along said transverse wall members of said individual tray sections;

a plurality of tongue recesses positioned adjacent and between said tongue members;

a plurality of rib members, each being positioned under said tongue recess; and a plurality of rib recesses formed adjacent and between said rib members, whereby said tongue members and said rib members of one individual tray section are adapted to couple with said tongue recesses and said rib recesses of an adjacent individual tray section.

25. A container in combination with removable baskets for shipping and storing fresh produce, wherein said combination comprises:

a basket-support tray having a substantially rectangular configuration;

a plurality of baskets adapted to receive said produce for shipping, storage and display therein, and to be carried by said basket-support tray;

a plurality of contiguous receptacles formed in said basket-support tray, said receptacles including means for removably supporting said baskets therein;

wherein said basket-support tray comprises:

an outer, peripheral, wall structure defined by four side wall members;

a plurality of integrally formed, longitudinally and transversely disposed, inner wall members;

all of said wall members defining said receptacles to receive and support said baskets therein;

a peripheral frame member mounted about the outer surface of said basket-support tray; and means formed between said peripheral frame member and said basket-support tray for interlocking a multiplicity of containers in a stacked arrangement to prevent separation thereof during shipping and storage;

wherein said interlocking means and said basket-securing means comprise:

a first longitudinal flange member formed along the upper edge of said peripheral frame member, and adapted to engage the upper edge of said baskets positioned adjacent thereto;

a second longitudinal flange member formed along the opposite lower edge of said peripheral frame member; and a peripheral shoulder formed on the outer surface of said outer wall structure, and adapted to engage said second longitudinal flange member, whereby said baskets are secured between said first longitudinal flange member and said support tray.

26. The combination as recited in claim 25, including means for separating said basket-support tray into a plurality of sectional groups of receptacles.

27. The combination as recited in claim 26, wherein said separating means comprises:

a pair of oppositely disposed slots formed in the upper and lower portions of said transverse wall members; and an intermediate web member formed between said oppositely disposed slots, and adapted to be separated.

28. The combination as recited in claim 27, wherein said longitudinal inner wall members and said transverse wall members are arranged to form four sectional groups, three receptacles being formed in each of said sectional groups.

29. A container adapted to receive and support removable baskets for shipping and storing fresh produce, wherein said container comprises:

a basket-support tray having a substantially rectangular configuration having a plurality of integrally formed, longitudinally and transversely disposed, outer and inner wall members;

a plurality of open-ended receptacles defined by an upper and lower opening formed in said basket-support tray, whereby said baskets are removably mounted in said open-ended receptacles, and wherein said open-ended receptacles are defined by said longitudinal and transverse wall members;

a peripheral frame member mounted about the outer surface of said basket-support tray defined by a continuous outer wall structure;

means formed between said peripheral frame member and said basket-support tray for interlocking a multiplicity of containers in a stacked arrangement to prevent separation thereof during shipping and storage;

means for securing individual baskets within said open-ended receptacles; and basket-support means formed in each of said open-ended receptacles.

30. A container as recited in claim 29, wherein said wall members of said basket-securing means each have a portion thereof extending downwardly therefrom for direct engagement with said baskets when said baskets are supported within said open-ended receptacles of said basket-support tray as said containers are stacked one over the other.

31. A container as recited in claim 30, wherein said interlocking means and said basket-securing means comprise:

a first longitudinal flange member formed along the upper edge of said peripheral frame member, and adapted to engage the upper edge of said baskets positioned adjacent thereto, whereby said baskets are secured between said first longitudinal flange member and said basket-support tray;

a second longitudinal flange member formed along the opposite lower edge of said peripheral frame member.

32. A container as recited in claim 31, wherein said basket-support means comprises an inner peripheral shoulder formed in the wall surfaces of said open-ended receptacles.

33. A container as recited in claim 30, wherein said basket-support means comprises inclined surfaces formed on said wall members of said open-ended receptacles to provide supporting engagement with the inclined walls of said baskets.

34. A container as recited in claim 29, wherein said longitudinal walls and said transverse walls are formed having lower extended portions to engage the upper portions of the superposed, adjacent, longitudinal and transverse walls when said containers are stacked for shipping and/or storage.

35. A container as recited in claim 29, wherein said container includes a secondary frame structure mounted so as to be positioned over and in engagement with said baskets to secure said baskets in said open-ended receptacles of said basket-support tray and against said basket-support means.

36. A container as recited in claim 35, wherein said secondary frame structure further defines a secondary basket-support tray formed having a plurality of side-by-side, open-ended receptacles adapted to support said baskets therein.

37. A container as recited in claim 36, wherein said open-ended receptacles in said secondary frame structure are defined by an outer peripheral wall, a plurality of transverse inner wall members, and a plurality of longitudinal inner wall members, wherein said wall members define upper and lower open ends to receive and support said baskets therein when said secondary frame structure is separated from said container.

38. A container formed to receive baskets for shipping and storing fresh produce, wherein said container comprises:

a basket-support tray having a substantially rectangular configuration;

a plurality of open-ended receptacles formed in said basket-support tray, said receptacles including means for supporting said baskets therein;

wherein said basket-support tray comprises:

an outer peripheral wall structure defined by four said wall members;

a plurality of integrally formed, longitudinally and transversely disposed, inner wall members;

all of said wall members defining said receptacles to receive and support said baskets therein;

a peripheral frame member mounted about the outer surface of said basket-support tray; and means formed between said peripheral frame member and said basket-support tray for interlocking a multiplicity of containers in a stacked arrangement to prevent separation thereof during shipping and storage;

wherein said interlocking means and said basket-securing means comprise:

a first longitudinal flange member formed along the upper edge of said peripheral frame member, and adapted to engage the upper edge of said baskets positioned adjacent thereto;

a second longitudinal flange member formed along the opposite lower edge of said peripheral frame member; and a peripheral shoulder formed on the outer surface of said outer wall structure, and adapted to engage said second longitudinal flange member, whereby said baskets are secured between said first longitudinal flange member and said support tray.

39. A container as recited in claim 38, including means for separating said basket-support tray into a plurality of sectional groups of receptacles.

40. A container as recited in claim 39, wherein said separating means comprises:

a pair of oppositely disposed slots formed in the upper and lower portions of said transverse wall members; and an intermediate web member formed between said oppositely disposed slots, and adapted to be separated.

41. A container as recited in claim 40, wherein said longitudinal wall members and said transverse wall members are arranged to form four sectional groups, three receptacles being formed in each of said sectional groups.

42. A container for removably supporting baskets for shipping and storing fresh produce, wherein said container comprises:

a basket-support tray having a substantially rectangular configuration;

a secondary frame structure adapted to be securely positioned over and in engagement with said baskets to retain said baskets in said open-ended receptacle and against said basket-support tray;

a plurality of receptacles formed in said basket-support tray, said baskets being removably mounted in said receptacles;

a peripheral frame member mounted about the outer surface of said basket-support tray; and means formed between said peripheral frame member and said basket-support tray for interlocking a multiplicity of containers in a stacked arrangement to prevent separation thereof during shipping and storage;

said interlocking means including means for securing said baskets in said basket-support tray;

wherein said basket-support tray comprises:

an outer peripheral wall structure defined by four side wall members;

a plurality of integrally formed, longitudinally and transversely disposed, inner wall members;

all of said wall members defining said receptacles to receive and support said baskets therein;

said walls of said receptacles including means for removably supporting said baskets therein; and wherein said interlocking means and said basket-securing means comprise:

a first longitudinal flange member formed along the upper edge of said peripheral frame member, and positioned to engage said secondary frame structure;

a second longitudinal flange member formed along the opposite lower edge of said peripheral frame member; and a peripheral shoulder formed in said outer wall of said basket-support tray, and positioned to engage said second longitudinal flange member, whereby said baskets are secured between said basket-support tray and said secondary frame structure.

* * * * *